US007690394B2

(12) United States Patent
Graybeal

(10) Patent No.: US 7,690,394 B2
(45) Date of Patent: Apr. 6, 2010

(54) HOT COLD WATER SUPPLY CROSSOVER MANIFOLD

(76) Inventor: Michael Graybeal, 2709 Scoggin Creek Rd., Bloomington, IL (US) 61704

( * ) Notice: Subject to any disclaimer, the term of this patent is extended or adjusted under 35 U.S.C. 154(b) by 899 days.

(21) Appl. No.: 11/440,903

(22) Filed: May 25, 2006

(65) Prior Publication Data

US 2007/0272304 A1 Nov. 29, 2007

(51) Int. Cl.
*F16L 5/00* (2006.01)

(52) U.S. Cl. ..... 137/360; 4/696; 285/124.1

(58) Field of Classification Search ..... 4/696, 4/640; 285/125.1, 122.1, 124.1; 248/65, 248/62, 68.1, 74.1; 138/106; 137/360
See application file for complete search history.

(56) References Cited

U.S. PATENT DOCUMENTS 1,762,619 A * 6/1930 Fleming ..... 4/640
3,349,797 A * 10/1967 Parr ..... 137/594
3,604,687 A * 9/1971 Moore ..... 256/65.04

* cited by examiner

*Primary Examiner*—John Rivell
*Assistant Examiner*—Macade Brown
(74) *Attorney, Agent, or Firm*—Robert C. Haldiman; Husch Blackwell Sanders LLP

(57) ABSTRACT

A crossover manifold system for hot and cold water faucet pairs arranged back to back on opposite sides of a partition, the system comprising a pair of manifold tubes, wherein each tube comprises a central section; a first intermediate section and a second intermediate section, wherein each intermediate section is adjacent to and angled with respect to the central section; and a first distal section and a second distal section, wherein each distal section is adjacent to and angled with respect to the first and second intermediate sections, respectively. The first and second distal sections are approximately parallel to one another, and the manifold tubes cross over one another.

24 Claims, 9 Drawing Sheets

Fig 4D
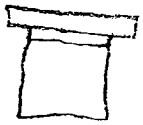
Fig. 4E
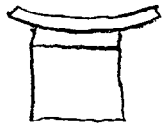
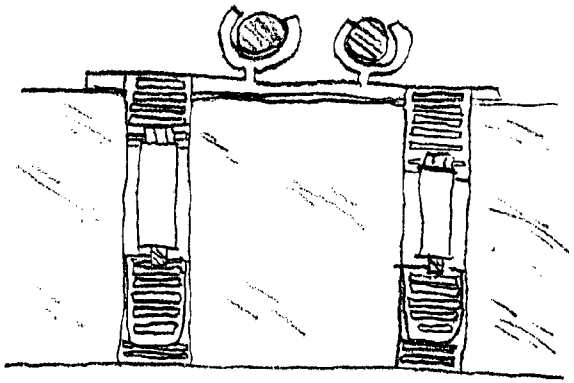
Fig. 4C

HOT COLD WATER SUPPLY CROSSOVER MANIFOLD

CROSS-REFERENCE TO RELATED APPLICATIONS

None.

BACKGROUND OF THE INVENTION

1. Field of the Invention

The present invention relates to plumbing fittings in general and in particular to a manifold assembly for aligning hot and cold water supply lines for back to back basins on opposite sides of a partition.

2. Related Art

In the plumbing trade and in particular in commercial buildings, plumbing fixtures are often situated directly opposite one another on opposite sides of a partition such as a wall in order to reduce the amount of plumbing lines that must be installed. Such arrangements might also be put in place on every floor of a multistory building so that the hot and cold water supply lines as well as drain/waste/vent pipes can run from floor to floor connecting to each fixture at each level with a minimum of plumbing lines.

Given the standard supply line arrangement for a basin wherein the hot water faucet is always on one side and the cold water faucet on the other (generally hot is on the left and cold is on the right), when there are back to back basins the supply lines must be crossed over for one of the basins in order for the supply lines to be properly oriented on each basin. Given that the opposing basins will also be sharing a common drain pipe system, the basins and their respective supply lines will be exactly lined up with one another. Therefore the hot and cold supply lines will protrude from opposite sides of the partition in exactly the same positions, i.e. with hot on the left and cold on the right on each side of the partition.

Any crossover manifold solution must be able to fit within the constricted space inside of the partition. This space is constricted due to the small area between the structural materials such as the studs and wallboard. Furthermore, other plumbing components such as drain/waste/vent (DWV) pipes are also usually in this space, since the drains for the basins are generally situated between the hot and cold supply lines. The remaining space between a two-inch DWV pipe and the wallboard is often less than one inch. Thus it is important that any manifold device for crossing over the supply lines must be made to strict tolerances in order to fit between the wallboard and DWV pipe. A further consideration is that the manifold device should preferably be convenient to install, having a bracket or other hanging component to hold the manifold in place during assembly and usage.

One traditional solution to this crossover requirement has been for a plumber to assemble a series of pipes, from individual components, into a manifold that crosses over the hot and cold water supply lines. While being expedient, this assembly of parts is costly in terms of parts and especially labor and thus is undesirable. Furthermore, such an assembly must have a high degree of accuracy in order for the manifold components to fit within the partition. In addition, every joint that is made has a chance of failing and leaking, and therefore the numerous joints required for producing a hand-made crossover manifold increases the overall chances that the manifold will leak. Finally, such a do-it-yourself solution does not provide a convenient mechanism for holding the manifold in place during installation.

Another solution for plumbers has been a single component crossover manifold such as that described in U.S. Pat. No. 3,583,004. However, such a manifold is very expensive such that the purchase price approaches the cost of a plumber's time to assemble a self-made manifold from individual components. Furthermore, such devices are extremely heavy, typically having two ends cast from brass, making installation difficult. Among the difficulties associated with installation is the fact that the heavy brass end fittings require application of a considerable amount of heat to solder copper pipes onto them. In use, the heavy brass fittings also absorb a great deal of heat when running hot water through them and thus require running hot water longer to produce acceptably hot water at the basin. In addition, installation of this prior art device requires the hot and cold water supply lines to be on opposite ends of the manifold and is not easily adapted to situations where the hot and cold water supply lines are on the same side of the manifold. Finally, these prior art manifold systems are not readily compatible with newer push- or press-to-fit connectors, further reducing their versatility.

A manifold for back to back basins is more likely to be required in a commercial setting, for example where there are adjacent bathrooms for men and women, than in single-family homes. As such, there is a strong preference among commercial builders and plumbers for plumbing pipes and fittings to be made from copper, as opposed to plastics, because of the perceived quality of copper and because of the compatibility with the rest of the plumbing network and familiarity of plumbers with using the material. Thus, given this strong market preference in the commercial sector for fittings made from copper rather than other materials such as plastics, any manifold solution should preferably be made of copper.

Thus, what is needed is a hot-cold crossover manifold that is pre-made with a minimum of connections, easy to install, inexpensive, and is preferably made of copper.

SUMMARY OF THE INVENTION

In one embodiment the invention is a crossover manifold system for hot and cold water faucet pairs arranged back to back on opposite sides of a partition, the system comprising a pair of manifold tubes, wherein each tube comprises a central section; a first intermediate section and a second intermediate section, wherein each intermediate section is adjacent to and angled with respect to the central section; and a first distal section and a second distal section, wherein each distal section is adjacent to and angled with respect to the first and second intermediate sections, respectively. The first and second distal sections are approximately parallel to one another, and the manifold tubes cross over one another.

In another embodiment the invention is a method of manufacturing a manifold system for hot and cold water faucet pairs arranged back to back on opposite sides of a partition. In this aspect the method comprises providing a pair of manifold tubes; bending each of the manifold tubes to produce a central section; a first intermediate section and a second intermediate section; wherein each intermediate section is adjacent to and angled with respect to the central section; and a first distal section and a second distal section, wherein each distal section is adjacent to and angled with respect to the first and second intermediate sections, respectively; wherein the first and second distal sections are approximately parallel to one another, and wherein the manifold tubes cross over one another.

In still another embodiment the invention is a crossover manifold system for hot and cold water faucet pairs arranged back to back on opposite sides of a partition. In this aspect the system comprises a pair of substantially identical manifold tubes and a mounting bracket for holding the tubes onto a drain/waste/vent pipe. The manifold tubes comprise a first tube and a second tube, wherein each tube comprises a central section; a first intermediate section and a second intermediate section, wherein each intermediate section is adjacent to and angled with respect to the central section; and a first distal section and a second distal section, wherein each distal section is adjacent to and angled with respect to the first and second intermediate sections, respectively. The first and second distal sections are approximately parallel to one another and to at least a portion of the central section; the first intermediate section is not co-planar with the second intermediate section; and the first and second intermediate sections of each tube are of different lengths and the first and second distal sections of each tube are of different lengths, such that the central section of each tube is asymmetrically disposed along the length of the tube. The mounting bracket holds the central sections of the tubes in a fixed position approximately parallel to one another; and the first tube is disposed in an opposite orientation relative to the second tube, such that the first distal section of the first tube is disposed adjacent to the second distal section of the second tube and the second distal section of the first tube is disposed adjacent to the first distal section of the first tube.

In yet another embodiment the invention is a crossover manifold system for hot and cold water faucet pairs arranged back to back on opposite sides of a partition. The system comprises a pair of manifold tubes comprising a hot water tube and a cold water tube, wherein each tube comprises a central section; a first intermediate section and a second intermediate section, wherein each intermediate section is adjacent to and angled with respect to the central section; and a first distal section and a second distal section, wherein each distal section is adjacent to and angled with respect to the first and second intermediate sections, respectively. The manifold tubes cross over one another, such that the first distal section of the hot water tube is parallel to the second distal section of the cold water tube and the second distal section of the hot water tube is parallel to the first distal section of the cold water tube.

In still another embodiment the invention is a method of installing a crossover manifold system for hot and cold water faucet pairs arranged back to back on opposite sides of a partition. The method comprises the steps of providing a first manifold tube and a second manifold tube; providing a mounting bracket; attaching the first and second manifold tubes to the mounting bracket; attaching the mounting bracket to a stationary structure within the partition; connecting a first end of the first manifold tube to a hot water supply line and to a first hot water valve; connecting a second end of the first manifold tube to a second hot water valve, such that the first hot water valve and the second hot water valve are installed on opposite sides of the partition; connecting a first end of the second manifold tube to a cold water supply line and to a first cold water valve; and connecting a second end of the second manifold tube to a second cold water valve, such that the first cold water valve and the second cold water valve are installed on opposite sides of the partition.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 4C shows a side view of one embodiment of a bracket for a manifold system as attached to a drain/waste/vent pipe using hose clamps with manifold tubes attached to the bracket;

FIG. 4D shows a top view of one embodiment of a bracket for a manifold system;

FIG. 4E shows a top view of another embodiment of a bracket for a manifold system;

DETAILED DESCRIPTION OF THE PREFERRED EMBODIMENTS

The following description of the preferred embodiment(s) is merely exemplary in nature and is in no way intended to limit the invention, its application, or uses.

Figure 1A:
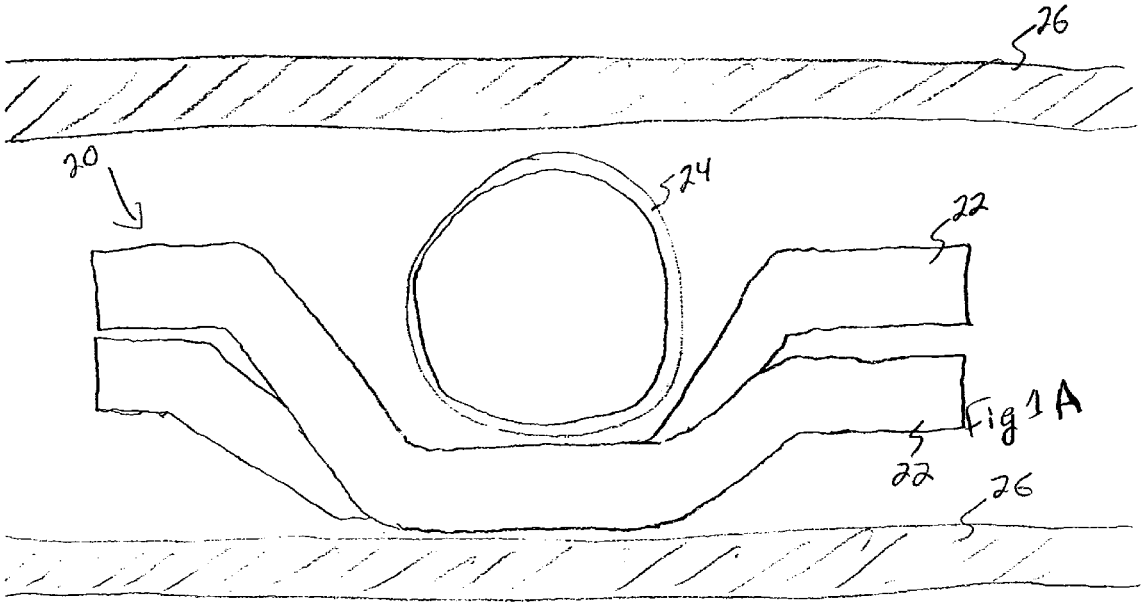
FIG. 1A shows a top view of an embodiment of the manifold system.
Figure 1B:
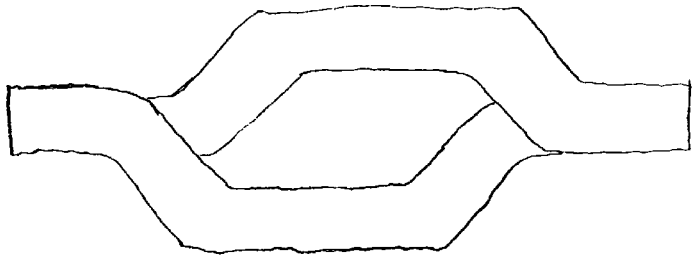
FIG. 1B shows a front view of an embodiment of the manifold system.
Figure 2:
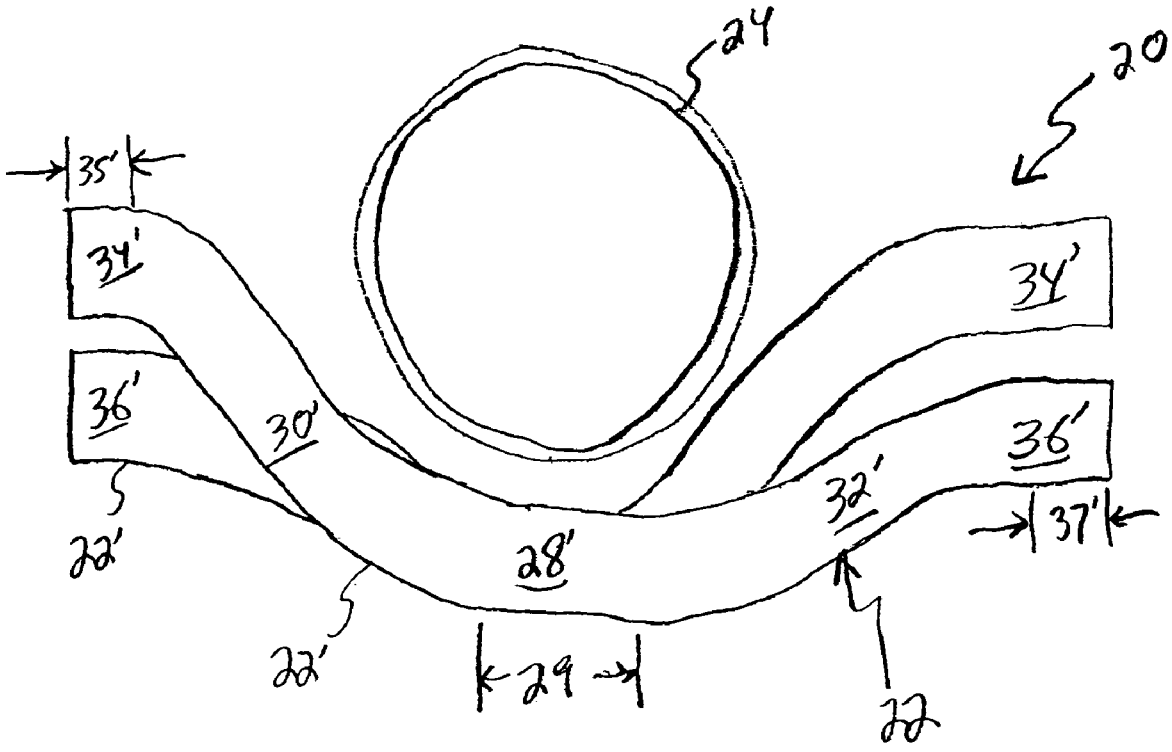
FIG. 2 shows a top view of one embodiment of a manifold system as installed next to a drain/waste/vent pipe.

In its simplest form a hot-cold crossover manifold 20 comprises a pair of manifold tubes 22 wherein each tube 22 comprises a single piece of material that is bent such that when laid adjacent one another the ends of each tube 22 are next to one another but the tubes 22 cross over one another at a point between the two ends (FIGS. 1A, 1B, 2).

Figure 3A:
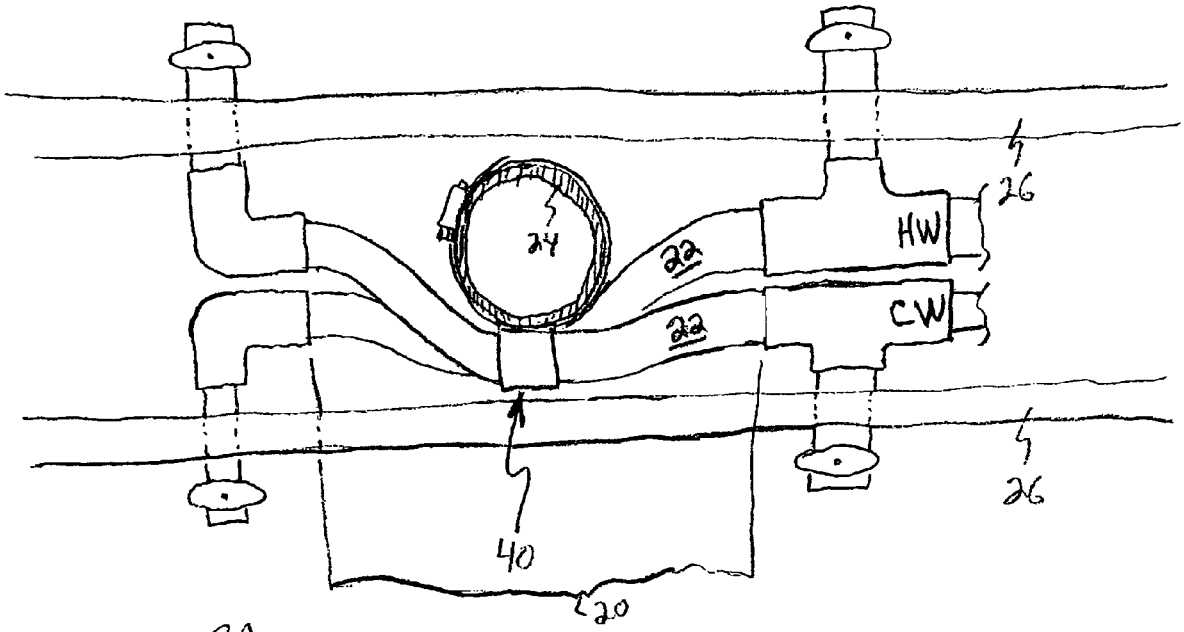
FIG. 3A shows an embodiment of a manifold system having an attachment bracket as installed in a partition next to a drain/waste/vent pipe, with both the hot and cold water supply lines on the same side of the drain/waste/vent pipe.
Figure 3B:
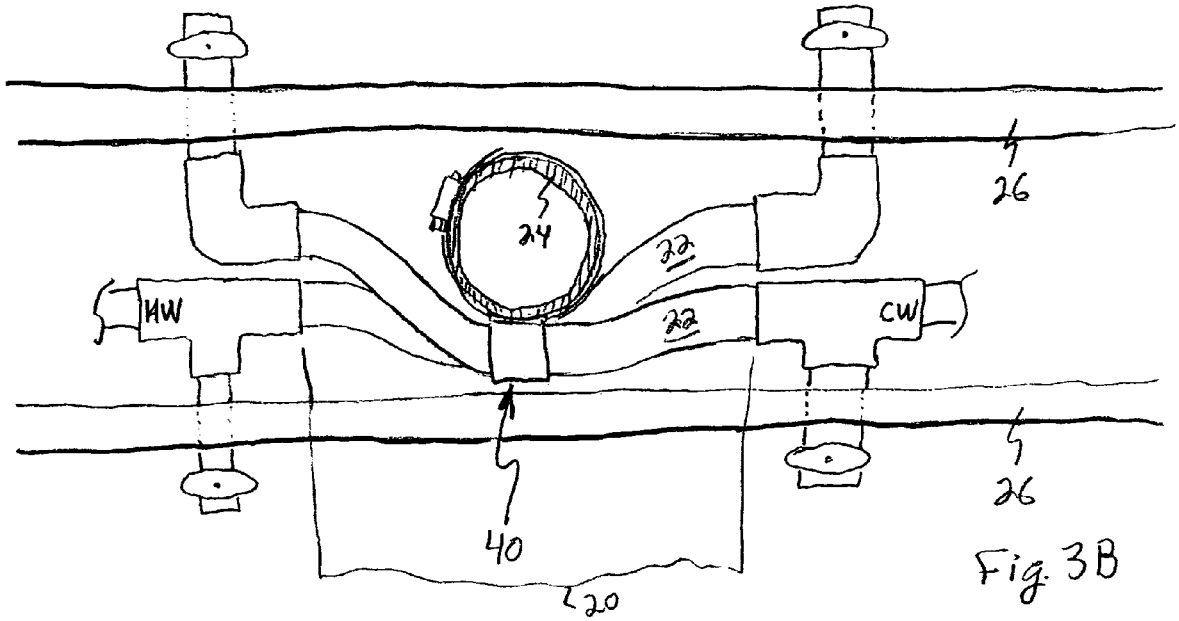
FIG. 3B shows an embodiment of a manifold system having an attachment bracket as installed in a partition next to a drain/waste/vent pipe, with the hot and cold water supply lines on opposite sides of the drain/waste/vent pipe.
Figure 4A:
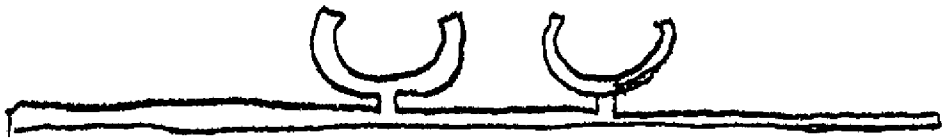
FIG. 4A shows a side view of one embodiment of a bracket for a manifold system.
Figure 4B:
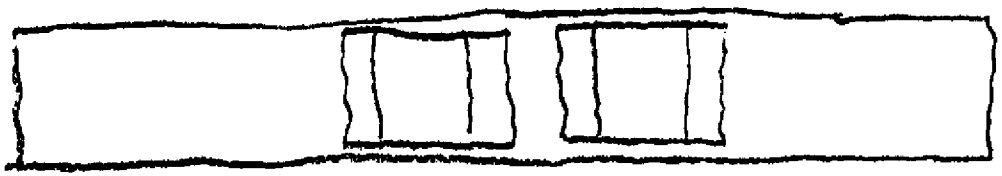
FIG. 4B shows a front view of one embodiment of a bracket for a manifold system.
Figure 4F:
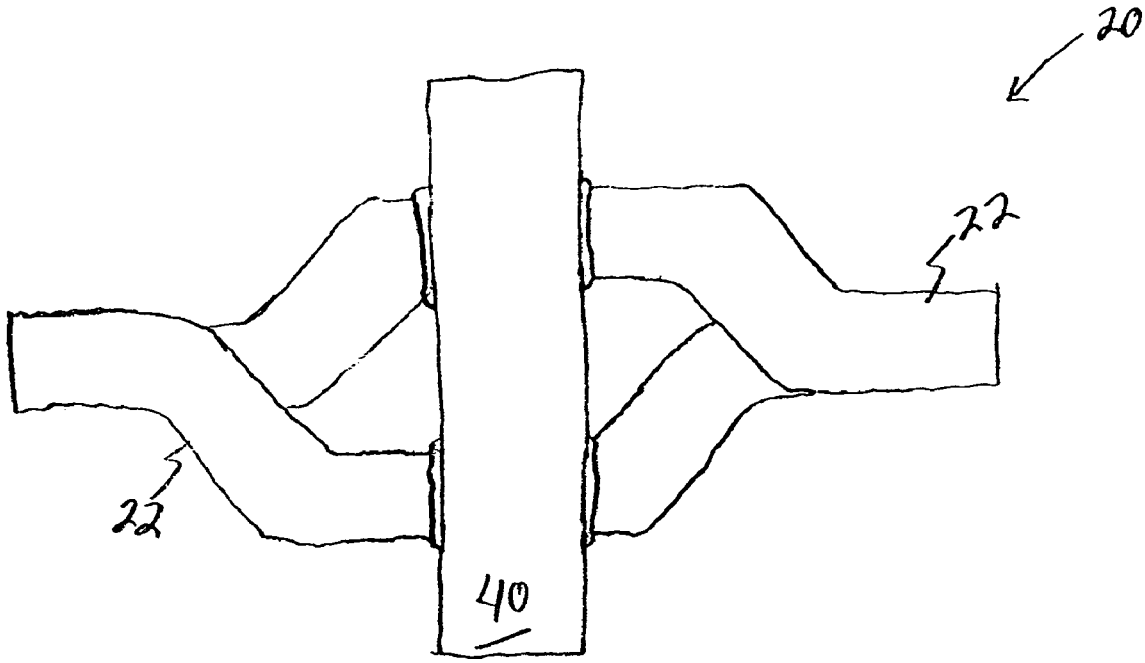
FIG. 4F shows a front view of another embodiment of a bracket for a manifold system wherein a piece of metal is welded to the manifold tubes.

In one embodiment (FIGS. 3A, 3B, 4C) the tubes 22 are held fixed relative to one another, for example by a metal bracket welded to the tubes 22 (FIG. 4F). In another embodiment the manifold 20 simply comprises two appropriately-shaped tubes 22 that cross over and attach to the correct supply lines and wall fittings (FIG. 1A). In yet another embodiment (FIGS. 3A, 3B) the crossover manifold 20 also comprises a bracket 40 to which the tubes snap in place, wherein the bracket 40 also comprises extensions for attachment to another structure such as a DWV pipe or a wall component such as a stud. Using the bracket 40 permits the manifold 20 to be held in place while the respective tubes 22 are attached to the hot and cold supply lines. In one embodiment the bracket 40 is plastic while in others it is metal. The bracket 40 may contain one or more extensions that project upward or downward, or both directions, permitting the extensions to be attached to a structure such as a DWV pipe by known means, e.g. a hose clamp (FIG. 4C). See below for a further description of the bracket 40.

In a preferred embodiment, in the approximate center region of the manifold 20 the two tubes 22 are oriented vertically relative to one another so that they can pass through what in most cases will be a very narrow space between a drain/waste/vent (DWV) pipe 24 and a partition material 26 such as drywall (FIGS. 3A, 3B). The vertical orientation also facilitates attachment of the tubes 22 to a bracket 40 as mentioned above and described further below. The vertically oriented portion of the tubes 22 should be offset laterally with respect to the ends of the tubes 22 such that the ends of the tubes 22 will be situated closer to the middle of the wall cavity while the vertically oriented center region will be situated to one side so as to go around the DWV pipe 24.

It is also preferred that the ends of the tubes 22 are oriented at the same horizontal level and in one embodiment the ends of the tubes 22 are co-aligned. Additional plumbing components such as elbows and T-fittings are then attached to the ends of the tubes 22 to tie into the respective hot or cold supply lines and to deliver the hot or cold water to the basins and to upper floors of the building as required.

In one embodiment (FIGS. 1A, 1B, 1D, 1E) each manifold tube 22 comprises a series of bends that permit the tube 22 to meet the specifications listed above, namely that the tubes 22 when installed are at the same horizontal level as one another at the ends, and in a center region are oriented vertically relative to one another such that the center region is offset laterally from the ends of the tube 22. In one embodiment the tubes 22 comprise a series of straight segments with angled bends at distinct points, whereas in another embodiment (FIG. 2) the tubes 22' comprise gradual curves wherein only the ends of the tubes 22' have identifiable straight portions, the straight portions being for making connections with other components.

Figure 1C:
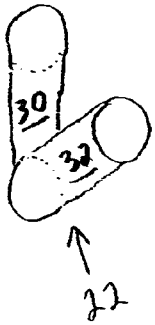
FIG. 1C shows an end view of one embodiment of a manifold tube.
Figure 1D:
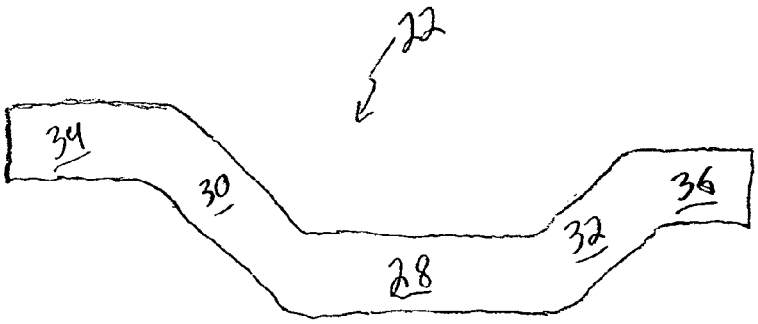
FIG. 1D shows a top view of one embodiment of a manifold tube.
Figure 1E:
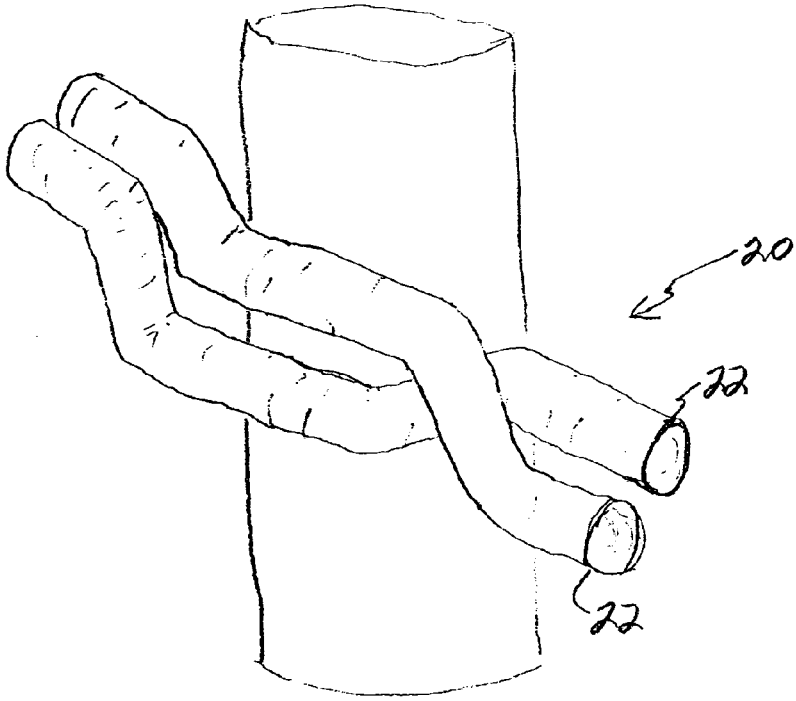
FIG. 1E shows a perspective view of an embodiment of a manifold system as installed next to a drain/waste/vent pipe.

In the first embodiments, wherein the tubes 22 comprise straight portions with distinct bends, each tube 22 comprises a central section 28 with a first intermediate section 30 and a second intermediate section 32 on either side of the central section 28, respectively. The angle between the central section 28 and either intermediate section 30, 32 is variable although in one embodiment is approximately 135°. The first and second intermediate sections 30, 32 are preferably not co-planar with one another (FIG. 1C), which permits two such adjacent tubes 22 to cross over one another without touching. In one embodiment the intermediate sections 30, 32, when viewed end-on, are at angle of approximately 30°-50° relative to one another, and in another embodiment are approximately 40° relative to one another.

Attached to the respective first and second intermediate sections 30, 32 are a first distal section 34 and a second distal section 36. The first and second distal sections 34, 36 are attached to the intermediate sections 30, 32 at the same angle as the first and second intermediate sections' 30, 32 attachment to the central section 28, thereby making the first and second distal sections 34, 36 approximately parallel to one another and approximately parallel to the central section 28.

To permit crossing over of the tubes 22 when they are situated adjacent one another while still permitting the respective ends of two adjacent tubes 22 terminate next to one another at the same horizontal level, the first and second intermediate sections 30, 32 have different lengths from one another. Furthermore, to keep the ends of the tubes 22 aligned in such a configuration, the first and second distal sections 34, 36 have different lengths from one another as well. One result of having the intermediate 30, 32 and distal 34, 36 sections being different lengths from one another is that the central section 28 is not necessarily situated in the exact middle of the two ends of the tube 22 (FIG. 1B). In a preferred embodiment, the longer of the intermediate sections is adjacent to the longer of the distal sections, which means that the central section 28 is not centered along the length of the tube 22 in this embodiment.

In a preferred embodiment the two tubes 22, 22' of a single manifold 20 are the same as one another, with one of the tubes being flipped lengthwise relative to the other (FIG. 1B). Given the preference of having the intermediate 30, 32 and distal 34, 36 sections of the tubes 22 being of unequal lengths and the fact that the intermediate sections 30, 32 of a given tube 22 are not co-planar, the two tubes 22 may be somewhat helical and circle around one another without touching, permitting the tubes to cross over one another. Since in a preferred embodiment the central sections 28 are not in the exact center of the tube 22 as viewed lengthwise, when two such tubes 22 are flipped relative to one another and situated adjacent one another, the central sections 28 will be offset, allowing the central sections 28 to be aligned vertically as preferred while still permitting the tubes 22 to cross over without touching one another.

In one particular embodiment of the manifold 20 having straight, rigid segments the approximate dimensions of the components of the manifold 20 are as follows, for a two inch nominal diameter PVC DWV pipe and using ½" nominal diameter copper tubing:

First distal section 34=1¾" long
First intermediate section 30=2" long
Central section 28=2½" long
Second intermediate section 32=1¼" long
Second distal section 36=1⅜" long
All angles between sections are approximately 135°

Given the above measurements, in this embodiment approximately half of the central section 28 from each tube 22 overlaps with the central section 28 of the other tube 22, such that the region of overlap is about 1¼" long (FIG. 1B).

In those embodiments where the tubes 22, 22' comprise continuous curves, the minimum requirements are as follows (FIG. 2).

Each tube 22' has a central curved section 28' that is analogous to the central section 28 described above. In one embodiment the central curved section 28' includes a short, relatively straight section 29' that permits the tube 22' to circumvent any possible obstruction, such as a DWV pipe 24, regardless of the orientation of the tube 22'. In addition, the straight section 29' near the center of the tube 22' facilitates its attachment to the bracket 40, as discussed further below.

At either end of the central curved section 28' are first and second intermediate sections 30', 32', respectively, wherein the curves change direction. In some embodiments the intermediate sections 30', 32' may be so short as to comprise only a reflex point wherein the direction of the curve changes, or the intermediate sections 30', 32' may comprise short straight segments.

Finally, the ends of the tubes 22' in a 'continuous curve' embodiment comprise first and second distal sections 34', 36', respectively, that are distal to the respective intermediate sections 30', 32'. Each distal section 34', 36' comprises a curved component that terminates in a first and second straight segment 35', 37', respectively. The straight segments 35', 37' permit attachment of connecting elements such as elbow joints, T-connectors, etc. The length of the straight segments 35', 37' corresponds to the particular socket depth of the fittings, e.g. for a ½" nominal diameter copper tube, the socket depth is ½" and thus the minimum length of the straight segments 35', 37' would be ½".

In all disclosed embodiments of the manifold 20, the end portions of the adjacent tubes 22, 22' when installed are preferably co-aligned and parallel to one another. Also, it is preferred that the opposing ends of the opposite tubes 22, 22' are approximately co-axial with one another, which makes it easier to attach other fittings to the ends since the ends will generally be situated in the same approximate locations.

In all embodiments the ends of the tubes 22, 22' are preferably sized to be the same as male pipe connectors for the particular size tubing that is employed. In one embodiment ½" nominal diameter copper tubing is used, although the invention encompasses other sizes and types of materials including plastics, such as PVC and CPVC, which are approved for use in water supply lines.

Figure 5:
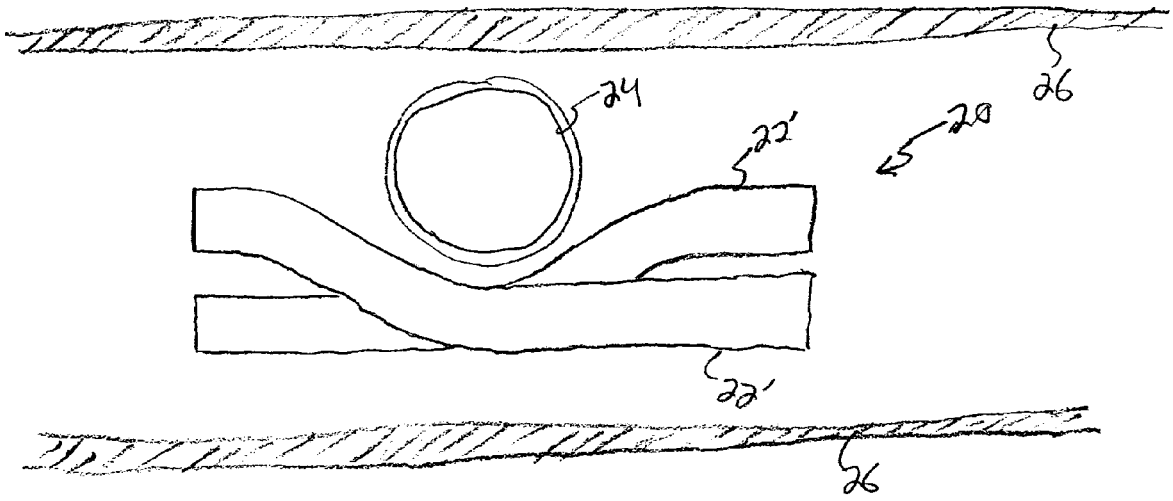
FIG. 5 shows a top view of another embodiment of a manifold system as installed in a partition next to a drain/waste/vent pipe.

In one embodiment the length of one intermediate section 30, 32, 30', 32' is essentially zero, such that one end of the tube 22, 22' is straight (FIG. 5). However, due to the need for space next to the ends of the tubes 22, 22' to attach fittings such as elbows, this embodiment will only work where there is sufficient space inside the wall cavity, so that the straight ends of the tubes 22, 22' are not too close to the partition material 26 (see FIG. 5). In other embodiments the positioning of the intermediate sections 30, 32, 30', 32' has the effect of positioning the ends of the tubes 22, 22' away from the partition material 26 (FIGS. 3A, 3B).

In any of the given embodiments above, the lengths of the tubes 22, 22' can be varied to accommodate numerous conventional center-to-center distances, as required, in order for the supply lines coming out of the walls to be at the correct spacing apart from one another.

An advantage of the disclosed embodiments, and in particular the continuously curved tube 22' embodiment, over other manifold systems is that there are no sharp bends that the water must flow through, thereby creating less turbulence and less resistance to flow.

In all of the embodiments the tubes may comprise rigid material, such as the aforementioned copper tubing or also rigid plastic material such as PVC or CPVC, or may comprise flexible materials such as rubber or flexible plastic pipes or tubing. Whatever material is used, however, it is preferred that the material is capable of being formed into the shapes described herein and maintaining those shapes when installed.

Upon installation the manifold 20 system is connected to the hot and cold water supply lines. In one embodiment the hot water supply HW is connected to a first tube 22, 22' at one end of the manifold 20 and the cold water supply CW is connected to a second tube 22, 22' at the opposite end of the manifold 20. In another embodiment the hot water supply HW and cold water supply CW lines are connected to different tubes 22, 22' at the same end of the manifold 20. Another installation advantage of the present manifold 20 system is that it can be easily adapted for use with various sizes of supply line tubing, for example ½" or ¾" nominal diameter tubing. This adaptation can be attained either by using a manifold 20 wherein the tubes are of the same nominal diameter as the supply lines, e.g. ½" or ¾" nominal diameter, or by attaching fittings that change the nominal diameter from one size to another, e.g. from ½" for the manifold tubing to ¾" for the supply line tubing. Thus, in contrast to certain prior art devices, the manifold 20 is easily adaptable to multiple supply line configurations.

In a preferred embodiment the manifold system 20 also comprises a bracket 40 for holding the tubes 22, 22' in place relative to one another and relative to the rest of the plumbing system, particularly during initial installation (FIGS. 4A-4F). In one embodiment the bracket 40 is a strip of material 42, such as plastic or metal, with two C-clips 44 situated on one side for snapping the tubes 22, 22' in place (FIGS. 4A-4E). The thickness of the strip of material 42 is dependent on the type of material used, for example if made of metal the strip of material 42 would not have to be as thick as if it were made of plastic in order to achieve a given level of rigidity and holding strength. In one embodiment the strip of material 42 is plastic and is approximately ⅛" thick and when installed the bracket 40 holds the tubes 22, 22' less than ¼" from a structure to which it is attached such as a DWV pipe 24.

The strip of material 42 above and below the C-clips 44 is then attached to a fixed object, generally a DWV pipe 24, using clamping means. In one embodiment the strip is attached to the DWV pipe 24 using a pair of hose clamps 46, one above and one below the pair of C-clips, although other modes of attachment including other types of clips other than C-clips are possible. In one embodiment the strip of material 42 is flat while in another embodiment the strip 42 has a curvature that matches the curvature of the structure, e.g. the DWV pipe 24, to which the bracket 40 is attached in order to make a more stable connection. The strip of material 42 and the C-clips 44 of the bracket 40 may be cast as a single component or may be assembled from separate pieces.

Using the described bracket 40, which has a relatively thin profile, the crossover manifold 20 of the present invention is capable of being fit within a wall cavity defined by a conventional two-by-four stud, which in fact creates a space of about 3½" between the pieces of partition material 26. Given that a DWV pipe 24 having a nominal inside diameter of 2" has an actual outside diameter of approximately 2½", this is possible since the disclosed bracket 40 holds the tubes 22, 22' less than ¼" away from the DWV pipe 24, and copper tubing with a nominal ½" diameter has an actual outside diameter of about ⅝". Thus the 2½" of DWV pipe 24, plus ⅝" of copper tubing, plus about ¼" (or less) of space between the tubing and the DWV pipe, equals 3⅜", which is less than the 3½" space created by the longer side of the nominally two-by-four stud (which actually measures about 3½" on its longer side, rather than 4" as stated). Thus compared to other commercially-available manifolds, the present crossover manifold 20 is more compact, which allows it to be fit into narrower wall cavity spaces.

For any given embodiment the tubes 22, 22' can be bent into the required shape using bending means, for example, a computer numerically controlled (CNC) tube bender or a manual tube bender. A CNC tube bender would facilitate large-scale manufacture of the bent tubes disclosed herein, since a CNC tube bender can make repeated, pre-programmed bends under computer control with a high degree of accuracy. Any such tube bending means would be used to bend angles between straight segments or to produce continuous curves, as described above.

To install a hot-cold crossover manifold 20 as in the present invention, the following steps are performed. First one provides a first and a second manifold tube 22, 22' along with a mounting bracket 40 and attaches the tubes 22, 22' to the bracket 40. Next the mounting bracket 40 is mounted to a stationary structure within the partition, such as a DWV pipe 24 or a wall stud. Subsequently, a first end of the first tube is attached to a hot water supply line, for example using a T-connector. In addition, the first end of the first tube is also connected, for example through one leg of the T-connector that is attached to the hot water supply line, to a first hot water valve that penetrates one side of the partition. Next, a second end of the first tube is connected to a second hot water valve that penetrates the opposite side of the partition. Given that the valves must have the same handedness on each side of the partition, the hot water valves will be in a diagonally opposite orientation relative to one another. Next, a first end of the second tube is connected to a cold water supply line and also to a first cold water valve on one side of the partition. Finally, a second end of the second tube is connected to a second cold water valve, wherein the second cold water valve is on the opposite side of the partition from the first. As with the hot water valves, the cold water valves are diagonally juxtaposed relative to one another to produce the correct handedness on each side of the partition. The hot and cold supply lines may be connected to the hot and cold manifold tubes either on the same end (FIG. 3A) or on opposite ends (FIG. 3B) of the manifold 20 using appropriate fittings. If the supply lines are on the same end of the manifold, then the first end of the first tube in the above description will be adjacent to the first end of the second tube. Similarly, if the supply lines are on opposite ends of the manifold, then the first end of the first tube will be adjacent the second end of the second tube.

The valves that are attached to and penetrate the partition 26 may then be attached to further supply tubes that carry the water to a faucet on a sink.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A crossover manifold system for hot and cold water faucet pairs arranged back to back on opposite sides of a partition, the system comprising:

a pair of substantially identical manifold tubes and a mounting bracket for holding the tubes onto a drain/waste/vent pipe, wherein the manifold tubes comprise a first tube and a second tube, each tube comprising:

a central section;

a first intermediate section and a second intermediate section, wherein each intermediate section is adjacent to and angled with respect to the central section; and a first distal section and a second distal section, wherein each distal section is adjacent to and angled with respect to the first and second intermediate sections, respectively;

wherein the first and second distal sections are approximately parallel to one another and to at least a portion of the central section;

wherein the first intermediate section is not co-planar with the second intermediate section;

wherein the first and second intermediate sections of each tube are of different lengths and the first and second distal sections of each tube are of different lengths, such that the central section of each tube is asymmetrically disposed along the length of the tube;

wherein the mounting bracket holds the central sections of the tubes in a fixed position approximately parallel to one another; and wherein the first tube is disposed in an opposite orientation relative to the second tube, such that the first distal section of the first tube is disposed adjacent to the second distal section of the second tube and the second distal section of the first tube is disposed adjacent to the first distal section of the first tube; and said manifold being substantially equidistant from each side of a wall space into which the manifold is installed.

2. A crossover manifold system for hot and cold water faucet pairs arranged back to back on opposite sides of a partition, the system comprising:

a pair of manifold tubes comprising a hot water tube and a cold water tube, wherein each tube comprises:

a central section;

a first intermediate section and a second intermediate section, wherein each intermediate section is adjacent to and angled with respect to the central section; and a first distal section and a second distal section, wherein each distal section is adjacent to and angled with respect to the first and second intermediate sections, respectively;

wherein the manifold tubes cross over one another, such that the first distal section of the hot water tube is parallel to the second distal section of the cold water tube and the second distal section of the hot water tube is parallel to the first distal section of the cold water tube; and said manifold being substantially equidistant from each side of a wall space into which the manifold is installed.

3. A crossover manifold system for hot and cold water faucet pairs arranged back to back on opposite sides of a partition, the system comprising:

a pair of manifold tubes, wherein each tube comprises:

a central section;

a first intermediate section and a second intermediate section, wherein each intermediate section is adjacent to and angled with respect to the central section; and a first distal section and a second distal section, wherein each distal section is adjacent to and angled with respect to the first and second intermediate sections, respectively;

the first and second distal sections being approximately parallel to one another, and the manifold tubes crossing over one another;

a mounting bracket for attachment of the tubes to a DWV pipe, wherein the mounting bracket holds the central sections of the tubes fixed relative to one another;

the first and second intermediate sections of each tube being different lengths and the first and second distal sections of each tube being different lengths the central sections being laterally offset such that said manifold defines a space sufficient for a DWV pipe to pass thereby while disposing said distal portions of said manifold tubes substantially equidistant from each side of a wall space into which the manifold is installed.

4. The manifold of claim 1 further comprising said central sections being laterally offset such that said manifold defines a space sufficient for a DWV pipe to pass thereby.

5. The manifold of claim 1 further comprising said distal portions of said manifold being substantially equidistant from each side of a wall space into which the manifold is installed.

6. The manifold of claim 1 further comprising said manifold pipes not touching one another.

7. The manifold of claim 1 further comprising said manifold being configured to fit within the substantially 4 inch space provided within a wall defined by a standard 2" by 4" stud.

8. The manifold of claim 1 further comprising said manifold tubes being helical.

9. The manifold of claim 1 further comprising the center section being substantially as wide as said DWV pipe.

10. A crossover manifold system for hot and cold water faucet pairs arranged back to back on opposite sides of a partition, the system comprising:

a pair of manifold tubes, wherein each tube comprises:

a central section;

a first angled section and a second angled section, wherein each angled section is adjacent to and angled with respect to the central section;

a first distal section and a second distal section, wherein each distal section is adjacent to and angled with respect to the first and second angled sections, respectively; and said first angled section being intermediate between said central section and said first distal section and said second angled section being intermediate between said central section and said second distal section wherein the first and second distal sections are approximately parallel to one another, and wherein the manifold tubes cross over one another; and said manifold being substantially equidistant from each side of a wall space into which the manifold is installed.

11. The crossover manifold system of claim 10 wherein the first and second distal sections are approximately parallel to at least a portion of the central section.

12. The crossover manifold system of claim 10 further comprising:

a mounting bracket for attachment of the tubes to a stationary structure, wherein the mounting bracket holds the central sections of the tubes fixed relative to one another.

13. The crossover manifold system of claim 10 wherein the first and second intermediate sections of each tube are of different lengths and the first and second distal sections of each tube are of different lengths.

14. The crossover manifold system of claim 10 wherein the central section of each tube is asymmetrically disposed along the length of the tube.

15. The crossover manifold system of claim 10 wherein the pair of tubes comprises a first tube and a second tube, wherein the first tube is disposed in an opposite orientation relative to the second tube, such that the first distal section of the first tube is disposed adjacent to the second distal section of the second tube and the second distal section of the first tube is disposed adjacent to the first distal section of the first tube.

16. The crossover manifold system of claim 12 wherein the stationary structure to which the mounting bracket is attached is a drain/waste/vent pipe.

17. The crossover manifold system of claim 10 wherein the first angled section is not co-planar with the second intermediate section.

18. The crossover manifold system of claim 12 wherein the central sections of the tubes are held parallel to one another by the bracket.

19. The crossover manifold system of claim 10 wherein the first distal section of the first tube is parallel to the second distal section of the second tube and the second distal section of the first tube is parallel to the first distal section of the second tube.

20. The crossover manifold system of claim 10 wherein the first tube is a hot water tube and the second tube is a cold water tube, such that the first distal section of the hot water tube is parallel and adjacent to the second distal section of the cold water tube, and the second distal section of the hot water tube is parallel and adjacent to the first distal section of the cold water tube.

21. The crossover manifold system of claim 12 wherein the bracket is attached to the drain/waste/vent pipe by a clamp.

22. The crossover manifold system of claim 10 wherein the tubes comprise a rigid material.

23. The crossover manifold system of claim 21 wherein the clamp is a hose clamp.

24. The crossover manifold system of claim 10 wherein a cold water supply line and a hot water supply line attach to the cold water tube and hot water tube, respectively, at the same end of the manifold.

* * * * *

UNITED STATES PATENT AND TRADEMARK OFFICE

CERTIFICATE OF CORRECTION

PATENT NO. : 7,690,394 B2
APPLICATION NO. : 11/440903
DATED : April 6, 2010
INVENTOR(S) : Michael Graybeal It is certified that error appears in the above-identified patent and that said Letters Patent is hereby corrected as shown below:

Col. 11, line 2, delete "4" and replace with -- 3 1/2 --

Signed and Sealed this

Fifteenth Day of June, 2010

David J. Kappos

David J. Kappos
*Director of the United States Patent and Trademark Office*